United States Patent [19]

Kondis

[11] 3,988,146

[45] Oct. 26, 1976

[54] PROCESS FOR PRODUCING LARGE PARTICLE SIZE ALUMINUM PIGMENTS BY WORKING AND WELDING SMALLER PARTICLES

[75] Inventor: Thomas J. Kondis, Pittsburgh, Pa.

[73] Assignee: Aluminum Company of America, Pittsburgh, Pa.

[22] Filed: May 5, 1975

[21] Appl. No.: 574,368

Related U.S. Application Data

[63] Continuation-in-part of Ser. No. 307,334, Nov. 17, 1972, Pat. No. 3,890,166.

[52] U.S. Cl. ..... 75/.5 A; 264/111; 264/117

[51] Int. Cl.[2] ..... B22F 1/00

[58] Field of Search ..... 264/117, 111, 68; 75/.5 A, .5 R

*Primary Examiner*—Robert F. White
*Assistant Examiner*—James R. Hall
*Attorney, Agent, or Firm*—John P. Taylor

[57] ABSTRACT

A process for the production of aluminum particles of uniform size and shape is provided comprising milling particulate aluminum in a non-oxidizing atmosphere and under inert conditions promoting welding using particular inert liquids which control the shape of the particle. Granular particles are produced by using inert aromatic liquids while platelet or leaf particles are produced using inert aliphatic liquids.

3 Claims, 6 Drawing Figures

GRADE #120 ATOMIZED ALUMINUM POWDER MILLED IN BENZENE

1mm

GRADE #120 ATOMIZED ALUMINUM POWDER MILLED IN BENZENE

1mm

1mm

GRADE #120 ATOMIZED ALUMINUM POWDER MILLED IN HEXANE

1mm

10MICRONS

GRADE #120 ATOMIZED ALUMINUM POWDER STARTING MATERIAL

1mm

10MICRONS

GRADE 1401 ATOMIZED ALUMINUM POWDER STARTING MATERIAL

GRADE#120 ATOMIZED ALUMINUM POWDER MILLED IN HEXANE 1mm

GRADE 1401 ATOMIZED ALUMINUM POWDER MILLED IN HEXANE 1mm

PROCESS FOR PRODUCING LARGE PARTICLE SIZE ALUMINUM PIGMENTS BY WORKING AND WELDING SMALLER PARTICLES

CROSS-REFERENCE TO RELATED APPLICATIONS

This application is a continuation-in-part of my parent application Ser. No. 307,334, filed Nov. 17, 1972 now U.S. Pat. No. 3,890,166 issued June 17, 1975.

BACKGROUND OF THE INVENTION

In my parent application cross-referenced above, I described and claimed milling aids which could be used in a process for milling particulate aluminum in the presence of an inert liquid to produce pyrophoric type surfaces which are chemically reactive and thus can be used in the formation of aluminum compounds such as, for example, organo aluminum compounds such as aluminum alkyls or the like.

I pointed out in the background of my parent application that particulate aluminum is sometimes milled in an inert atmosphere in the presence of inert hydrocarbons such as hexane, kerosene, benzene, mineral spirits, or the like, to avoid excessive formation of an oxide-coated surface and to produce aluminum which would then combine under pressure with hydrogen gas and an olefin such as ethylene or isobutylene to form an alkylaluminum compound. In all instances that I am aware of, however, such prior art milling practices have been carried out in the presence of aluminum alkyls, which comprise a major proportion of the initial reaction medium wherein the milled aluminum particles with their fractured oxide coatings are made to react under elevated temperature and pressure according to the following scheme, depicted for triethylaluminum:

$$2Al + 3H_2 + 4(C_2H_5)_3\,Al \rightarrow 6(C_2H_5)_2\,AlH \quad (1)$$
$$6(C_2H_5)_2\,AlH + 6C_2H_4 \rightarrow 6(C_2H_5)_3\,Al \quad (2)$$
$$2Al + 3H_2 + 6C_2H_4 \rightarrow 2(C_2H_5)_3\,Al \quad (3)$$

This initial stage of commercial alkylaluminum production, as indicated by reaction (1), involves dissolution of metallic aluminum in alkylaluminum product recycled from a later stage in production [reaction (2)] to form dialkylaluminum hydride. The latter compound is then combined with an olefin to generate trialkylaluminum, indicated by reaction (2). As can be seen in reactions (1) and (2), six molecules of alkylaluminum product are formed for every four molecules present in the initial reaction stage, so that the overall stoichiometry depicted as reaction (3) is a net production of alkylaluminum from aluminum, hydrogen and olefin. Thus, because aluminum alkyls are required in the reaction mixture, they are commonly introduced into the mill (in those cases where milling is the preferred method to activate the aluminum particles by fracturing the oxide protective coating) where they also serve as a carrier liquid for the aluminum particles. In no instances am I aware that anyone practices the milling of particulate aluminum under an inert liquid condition in the absence of alkyl compounds, perhaps because it is known that in such instances the milled particles will merely weld back together again thus defeating the milling operation if the purpose of the milling operation is to provide pyrophoric surfaces.

However, during the course of my experimentation with the use of milling aids, I discovered that this welding phenomena could be used and controlled to provide control of the size and shape of the particle as well as control of the particle size distribution. For example, if particles of a given size are desired, this could be produced conventionally by milling larger particles down to approximately that particle size range. However, such conventional milling practices (usually under oxidizing condition) result in the production of a large amount of undesirable fines which not only waste material but create another separation problem as well.

SUMMARY OF THE INVENTION

What has now been discovered is a process for producing fine particulate aluminum such as atomized aluminum by milling in an inert liquid to produce a larger particle of predetermined shape and size and having a particle size distribution range considerably narrower than would be obtained using conventional practices of milling down of larger particles. In accordance with the invention, I have found that atomized aluminum particles may be ground in an inert liquid to produce either granular or plate-like leaf particles depending upon the choice of inert liquid used as the grinding or milling medium. I have also found that the size of the eventual particle is related to the initial size of the atomized powder.

In an alternate embodiment, the aluminum particles are first milled in accordance with the invention claimed in my parent U.S. Pat. No. 3,890,166 and subsequently milled under conditions promoting welding.

DESCRIPTION OF THE INVENTION

Figure 1:
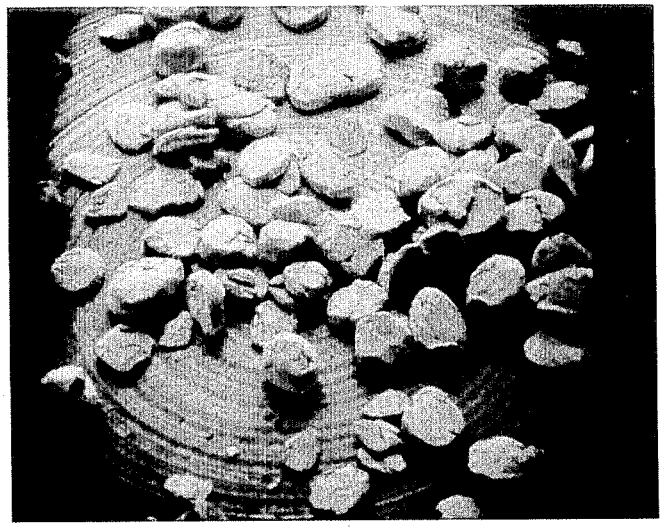
FIG. 1 is a photomicrograph of granules produced by milling in an inert aromatic liquid (benzene).

In accordance with the invention, atomized aluminum particles are charged to a mill and ground in the presence of an inert organic liquid, and in the absence of an oxidizing atmosphere, to promote welding conditions within the mill causing the particles to reweld together, thus forming a larger particle.

The exact initial shape of the particle used to charge to the mill is not important with respect to whether or not a larger welded particle may be obtained therefrom. For example, various sizes of granular or atomized particles ranging from several microns to 2000 microns can be used. Alternatively, flitter or shredded aluminum foil could also be used as the starting material.

The feedstock particles may first be modified to a finer form, if desired, by initially milling in the presence of a milling aid according to the teachings of my parent U.S. Pat. No. 3,890,166. After exhaustion of the milling aid, the milling environment reverts to one promoting welding rather than comminution, and these finer particles then become feedstock for producing welded particles. Aluminum oxide may be introduced into the interior of such welded particles by following the practices of my co-pending U.S. patent application Ser. No. 574,370 entitled "Large Size Aluminum Particle Containing Aluminum Oxide Therein" filed concurrently with this application on May 5, 1975, or may be omitted by eliminating the controlled oxidation step between the comminution and welding milling modes.

In accordance with the invention, the particles are milled in a conventional ball mill comprising balls having a spherical shape, a ⅛ inch to ½ inch size and made of steel material. The particles are usually milled for about ½ to 24 hours.

In accordance with the invention, an inert organic liquid is used to facilitate milling of the particles and to control the shape of the ultimate particles. For example, an aromatic organic liquid such as, for example, benzene, xylene, or toluene, is used when it is desired to have granular particles. On the other hand, an aliphatic organic liquid is used to produce particles having a platelet or leaf-like shape. Examples of such liquids include hexane, octane, mineral spirits, and cyclohexane. It should be noted, however, that organic hydrocarbons that are sterically hindered to the extent that they easily fragment into free radicals are not considered to be inert but rather lead to comminution as more particularly described in my parent application. Such materials, for example, would include hexaphenylethane which dissociates to form triphenylmethyl radicals or tetraphenyl hydrazine which dissociates to form diphenyl nitrogen. Neither are olefins considered to be inert, as it was demonstrated in my parent application that their unconjugated double bond has enough affinity to the nascent aluminum surface to allow mildly pyrophoric powder to be produced in the mill. Such olefins as ethylene and 2-hexene were thus illustrated in my parent application.

The milling is carried out in a non-oxidizing atmosphere. This atmosphere can be obtained by exhausting all oxidizing gases or, alternatively, by using an inert gas blanket such as nitrogen, argon, or the like. A reducing gas could also be used. The term "non-oxidizing atmosphere" thus, for purposes of this application, should be deemed to include vacuum, inert gases, or reducing gases. The following examples will further serve to illustrate the invention.

EXAMPLE 1

35.0 g. Alcoa grade No. 120 atomized powder, whose sieve analysis is summarized in Table I, were charged into a one-liter capacity stainless steel vibratory mill.

TABLE I

Sieve Analysis (Typical)
Alcoa Grade No. 120 Atomized Powder
Surface Area/Mass Ratio = 0.20 $m^2/g$

| U.S. Sieve (Std.) | |
|---|---|
| on 40 mesh | Trace |
| through 40, on 100 mesh | 20% |
| through 100, on 200 mesh | 25% |
| through 200, on 325 mesh | 20% |
| through 325 mesh | 35% |

A mixture of ½ inch and ¼ inch diameter stainless steel balls was used as the grinding media. The mill atmosphere was then evacuated, and 175 ml. hexane carrier was admitted, after which the mill was sealed shut and the aluminum particles milled for 2 hours. After milling, the mill was opened, the hexane-powder slurry filtered, and the product powder examined. The milled powder exhibited no pyrophoric behavior as it was separated from the highly volatile and flammable hexane liquid, indicating that it had a very low surface area/mass ratio.

It was found that the dull gray, granular No. 120 atomized powder particles had been welded into large, shiny, leaf-like or platelet aluminum particles, essentially all of which remained on a 40 mesh U.S. Sieve. A measurement of the surface area/mass ratio, after the procedure of J. E. Lewis and R. C. Plumb ("A Radiochemical Technique for Determining the Specific Surface Area of Aluminum Metal Surfaces", International Journal of Applied Radiation and Isotopes, Volume 1, pages 33–45, 1956), confirmed that a high degree of welding and forming had taken place, in that a more than two-fold reduction of this ratio to 0.08 $m^2/g$ had occured.

The identical conditions were repeated except that the following liquids as shown in the table were substituted for hexane:

TABLE II

| Inert Milling Liquid | Type | Product Shape | Product Appearance | Surface Area/Mass Ratio of Product |
|---|---|---|---|---|
| Hexane | Aliphatic | Plates | Shiny | 0.08 $m^2/g$ |
| Octane | Aliphatic | Plates | Shiny | 0.02 |
| Mineral Spirits | Aliphatic | Plates | Shiny | 0.08 |
| Cyclohexane | Cyclic Aliphatic | Plates | Shiny | 0.10 |
| Benzene | Aromatic | Granules | Shiny | 0.06 |
| Xylene | Aromatic | Granules | Shiny | 0.13 |

Figure 2:
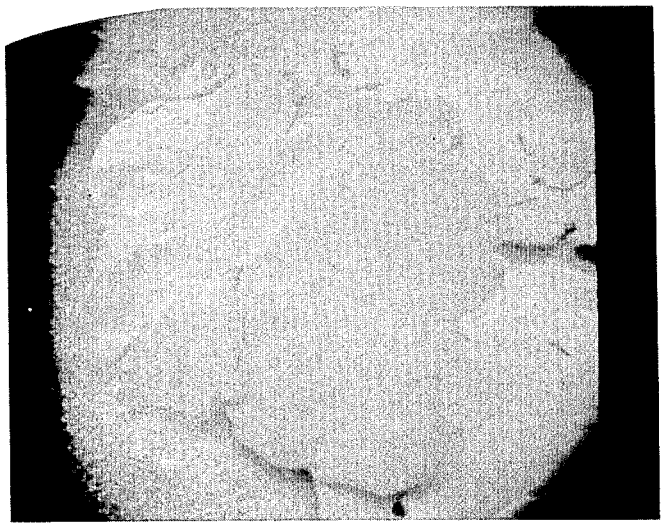
FIG. 2 is a photomicrograph of a single flake produced by milling in the presence of an inert aliphatic liquid (hexane).

An electron scanning photomicrograph of the granules produced in benzene media is demonstrated as FIG. 1. A single flake of the hexane-milled product is shown as FIG. 2, blown up to expose the working and welding.

Thus it can be seen that using identical starting material and grinding under identical conditions, the shape of the particle is dependent upon whether or not the inert liquid grinding media was an aliphatic liquid or aromatic liquid.

EXAMPLE 2

The hexane experiment of Example 1 was repeated, except that 15 psi nitrogen gas was introduced into the mill after admitting the hexane. The mill was then sealed and the contents milled as before.

Figure 3:
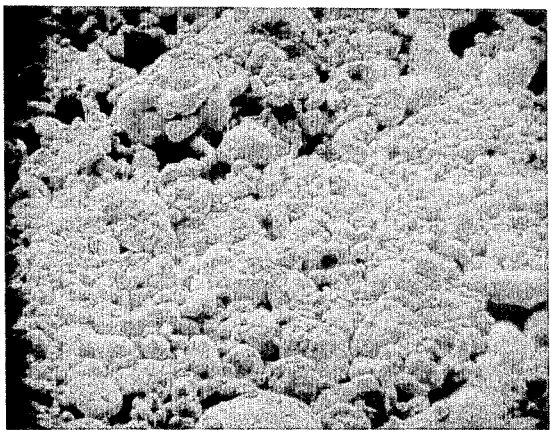
FIG. 3 is a photomicrograph of a particular grade of atomized powder used as starting material.
Figure 4:
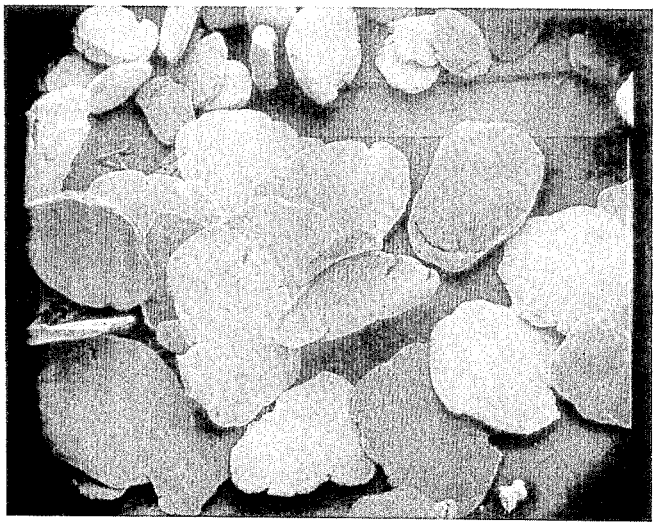
FIG. 4 is a photomicrograph of flakes produced by milling the atomized powder of FIG. 3 in hexane.

The product powder was found to be essentially like that of Example 1. The relatively uniformly-sized product platelets were measured, and most were found to fall into a size range between 1.0 and 2.0 millimeters in diameter. An electron scanning photomicrograph of the No. 120 atomized powder starting material is shown in FIG. 3 while the resultant product platelets are shown in FIG. 4.

EXAMPLE 3

Figure 5:
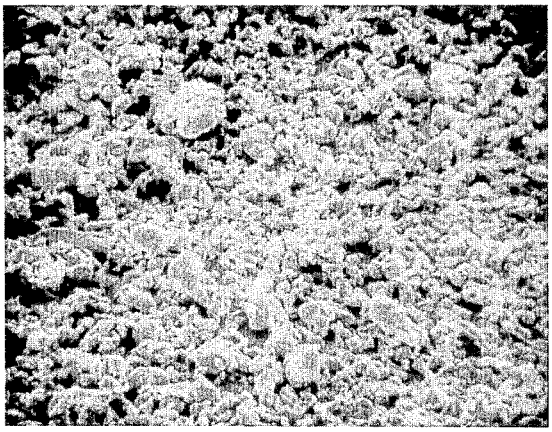
FIG.5 is a photomicrograph of a finer grade of atomized aluminum starting material than that shown in FIG. 3.

The experiment of Example 2 was repeated, except that Alcoa grade No. 1401 atomized powder was used as the starting material. A photomicrograph of this starting material is shown at FIG. 5. Typically, 99% of these dull, gray particles pass through a 325 mesh U.S. Sieve, with no more than 2% being retained on that sieve (but passing 200 mesh).

Figure 6:
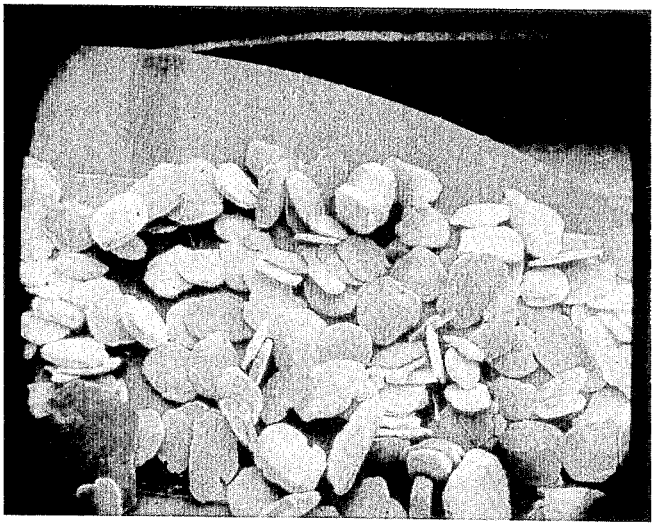
FIG. 6 is a photomicrograph of flakes produced by milling the atomized powder of FIG. 5 in hexane.

The product platelets were similar to those of Example 2, but were uniformly smaller in diameter. Most of the particles were found to measure between 0.5 and 1.0 millimeters in diameter. Thus, it can be seen that, while the shape of the particle is entirely changed via the milling, the size of the ultimate product is related to the size of the starting material. This is demonstrated more clearly by comparing FIG. 6, an electron scanning photomicrograph of the product powder from this Example, with FIG. 4, (which illustrates the product formed in Example 2). FIGS. 1, 4 and 6 were all produced at the same magnification.

Thus it can be seen that while the initial starting material has a wide variation in particle size, the final product is surprisingly very uniform in size. This is quite surprising since, as noted above, the size of the initial particles does seem to have some effect upon the size of the final product.

Having thus described my invention, what is claimed is:

1. The process of producing aluminum particles of predetermined shape and size which comprises milling in a non-oxidizing atmosphere particulate aluminum of a given particle size range in the presence of an inert liquid selected from the group consisting of aliphatic and aromatic organic liquids which do not fragment into free radicals to thereby promote welding of the particulate aluminum into larger particles of predetermined shape and size.

2. The process of claim 1 wherein said particulate aluminum is milled in an inert aliphatic liquid to produce planar shaped aluminum particles.

3. The process of claim 1 wherein said particulate aluminum is milled in an inert aromatic liquid to produce granular aluminum particles.

* * * * *